US005546653A

United States Patent [19]

Tournier et al.

[11] Patent Number: 5,546,653

[45] Date of Patent: Aug. 20, 1996

[54] CRIMPING TOOL FOR THE CONNECTION OF AN ELECTRIC CABLE IN AN END ELEMENT

[75] Inventors: Gilles Tournier, Lequevin; Stéphane Seguier, Toulouse, both of France

[73] Assignee: Societe Nationale Aerospatiale Industrielle, Paris, France

[21] Appl. No.: 314,828

[22] Filed: Sep. 29, 1994

[30] Foreign Application Priority Data

Oct. 1, 1993 [FR] France ..... 93 11712

[51] Int. Cl.[6] ..... H01R 43/042

[52] U.S. Cl. ..... 29/751; 29/758; 72/409.09; 81/349

[58] Field of Search ..... 29/750, 751, 758, 29/863, 280; 7/107; 72/402, 410, 413, 315; 81/349, 350, 351

[56] References Cited

U.S. PATENT DOCUMENTS

| | | | |
|---|---|---|---|
| 2,369,180 | 2/1945 | Rosenthal | 29/751 X |
| 3,126,750 | 3/1964 | Willis . | |
| 3,491,577 | 1/1970 | Lingenbrink | 72/402 |

FOREIGN PATENT DOCUMENTS

| | | | |
|---|---|---|---|
| 1287793 | 8/1962 | France | 29/751 |
| 435274 | 10/1926 | Germany . | |
| 5234658 | 9/1993 | Japan | 29/751 |
| 263445 | 5/1964 | Netherlands | 72/410 |
| 93-14535 | 7/1993 | WIPO . | |

*Primary Examiner*—Peter Vo
*Attorney, Agent, or Firm*—Michael N. Meller

[57] ABSTRACT

To permit the connection of an electric cable (12) in an end element (10) having a partly frustum-shaped outer surface, a crimping tool is proposed incorporating a gripping plier (50) and a crimping die (60). When the element (10) to be crimped has Been placed in a recess (48), an actuation of the tool has the effect of the element (10) being gripped by the plier (50), the closure of the die (60) and then the application of a tension to the end element by said plier (50), so as to make the die pass through said element. The die (60) then opens automatically and remains open until the tool has returned to the inoperative position.

11 Claims, 5 Drawing Sheets

CRIMPING TOOL FOR THE CONNECTION OF AN ELECTRIC CABLE IN AN END ELEMENT

DESCRIPTION

The invention relates to a crimping tool making it possible to connect, by crimping, the bare end of an electric cable in an end element such as a connector contact, whose outer surface has initially at least one frustum-shaped section.

The crimping tool according to the invention can in particular be used for crimping the bare end of an electric cable in an end element such as that described in FR-A-2,686,459. Said end element is a body of revolution made from a deformable and electrically conductive material and having along its axis a stepped blind hole, whose two sections are provided for receiving the bare end of the cable and the end of the cable protective sheath respectively. The external diameter of the body is frustum-shaped and increases regularly towards the open end of the blind hole. Consequently when the body is subject to a crimping operation by drawing having the effect of giving its outer surface a cylindrical shape of uniform diameter, the cable end is tightly connected to said body.

It should be noted that the crimping tool according to the invention can be used for the connection to the end of an electric cable an end element significantly different from that described in FR-A-2,686,459. Thus, the end element described in the latter document constitutes an intermediate part for subsequent introduction and then crimping in a connector contact, whereas the crimping tool according to the invention can be used for directly crimping a connector contact on the end of an electric cable.

At present no tool exists making it possible to carry out crimping by wire drawing of an end element like that described in FR-A-2,686,459 to an electric cable. The object of the invention is to supply such a tool.

The invention therefore proposes a crimping tool for the connection of an electric cable in an end element having an outer surface, whereof at least one section is initially frustum-shaped, characterized in that it comprises:

- a tool body provided with a recess having a given longitudinal axis and able to receive the end element,
- a gripping plier located in a rear portion of the recess and able to move along said longitudinal axis between a front loading position and a rear end of crimping position,
- means for the automatic closure of the gripping plier outside its front loading position,
- a crimping die located in the tool body around a recess entrance portion and able to occupy a crimping position and an open position and
- crimping control means for maintaining the crimping die in the crimping position when the gripping plier moves from its front loading position to its rear end of crimping position, and an open position when the gripping plier occupies one of its rear and front positions and when it moves from its rear position to its front position.

In a preferred embodiment of the invention, the crimping die comprises crimping pistons slidingly mounted in the tool body, according to regularly distributed radial axes intersecting the longitudinal axis at the same point.

In this preferred embodiment, the crimping control means advantageously incorporate an annular member surrounding the crimping pistons and internally provided with cam surfaces, elastic means maintaining said crimping piston in engagement with said cam surfaces, and means for linking in translation, parallel to said longitudinal axis, the gripping plier and the annular member.

Preferably, the means for linking in translation the gripping plier and the annular member comprise a pin, which traverses a tubular portion of the tool body on which slides said annular member. The cam surfaces formed within the annular member comprise:

- a rear cylindrical zone of relatively large diameter and in front of which are located the crimping pistons in a front position of the annular member corresponding to the front loading position of the gripping plier,
- a front cylindrical zone of relatively small diameter and in front of which are located the crimping pistons between the front position of the annular member and a rear position of said member corresponding to the rear, end of crimping position of the gripping plier and
- the same number of open helical grooves as there are crimping pistons, said grooves being regularly distributed on the periphery of the front cylindrical zone over the same depth as the rear cylindrical zone.

The pin by which the gripping plier is linked in translation with the annular member traverses windows formed in the tubular portion of the tool body. These windows allow a slight rotation of the annular member relative to the tool body and comprise an inclined ledge able to come into contact with the pin in order to automatically bring the annular member into a given angular position, when it occupies its front position. This given angular position is such that the crimping pistons are then angularly aligned with the front ends of the grooves and angularly displaced with respect to the rear ends of the grooves.

In the preferred embodiment of the invention, the crimping control means incorporate a manipulating member able to exert a tensile force on the gripping plier, towards the rear of the recess and means for returning the manipulating member to its inoperative position.

The gripping plier advantageously comprises at least two jaws urged towards an open position by second elastic means, the automatic closing means being constituted by a reduced diameter section of the rear portion of the recess.

Preferably, the gripping plier comprises noses able to engage with a shoulder formed for this purpose on the outer surface of the end element.

The invention is described in greater detail hereinafter relative to a non-limitative, preferred embodiment and with reference to the attached drawings, wherein show:

DETAILED DESCRIPTION OF THE DRAWING

Figure 1:
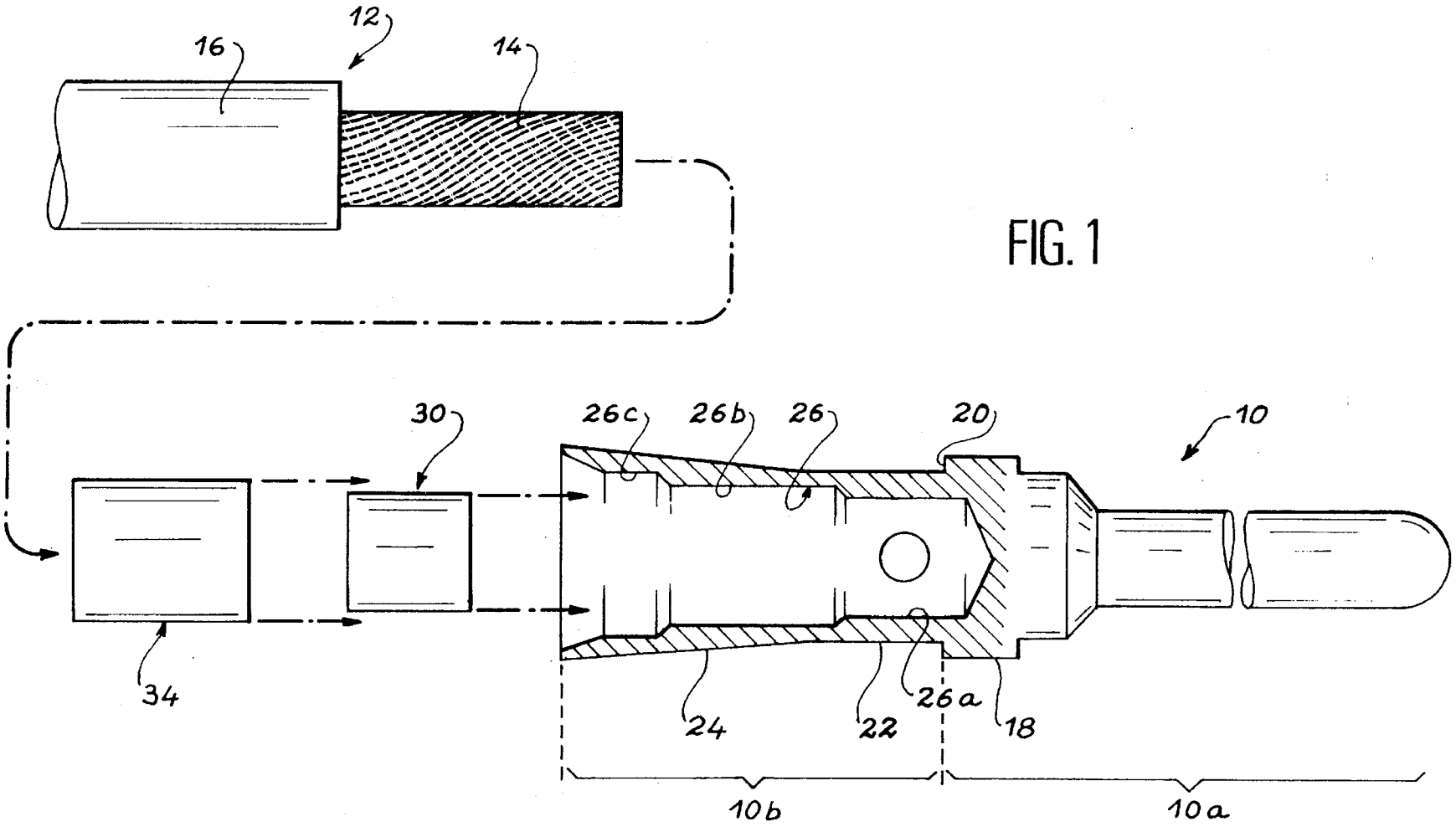
FIG. 1 A part longitudinal sectional view of an end element such as an electric contact and an electric cable for connection with the aid of a crimping tool according to the invention.

FIG. 1 shows an end element 10 such as an electric contact, prior to its connection by crimping using a tool according to the invention, to the end of an electric cable 12 formed from a metal core 14 and an insulating sheath 16. The sheath 16 covers the core 14 of the cable 12, with the exception of its end, which is bared over a predetermined length.

The end element 10 is made from an electrically conductive material and which has good cold deformation properties, such as a copper alloy. It has a symmetry of revolution about a longitudinal axis and has a standardized front portion 10*a* and a rear connection portion 10*b*.

The front portion 10*a* of the end element 10 can assume various shapes and sizes as a function of the intended application. It has a collar 18, which defies a shoulder 20 turned towards the rear connection portion 10*b*.

The rear connection portion 10*b* of the end element 10, which commences immediately behind the shoulder 20, has an outer surface which successively defines, starting from said shoulder, a uniform diameter cylindrical portion 22 and a frustum-shaped portion 24, whose diameter increases from the cylindrical portion 22 to the end of the element 10.

A stepped blind bore 26 is formed coaxially in the rear connection portion 10*b* of the end element 10 and extends to the interior of the collar 18. In the embodiment shown, starting from the bottom, said bore 26 has a cylindrical bottom section in two portions 26*a*, 26*b* and an entrance section 26*c*. The cylindrical bottom section formed by the portions 26*a* and 26*b* receives the bare portion of the cable 12, whereas the cylindrical entrance section 26*c* receives the end of the sheath 16.

A sealing bush 30 and an interface ring 34 are slightly force fitted in the portions 26*a* and 26*b* of the cylindrical bottom section of the bore, so as to be interposed between the bare portion of the cable 12 and the end element. In order to facilitate their putting into place, the diameter of the bottom portion 26*a* is smaller than that of the intermediate portion 26*b*, which is itself smaller than the diameter of the entrance section 26*c*. The entrance ends of each of the portions 26*a* and 26*b* and of the section 26*c* have a chamfer.

The intermediate portion 26*b* and the entrance section 26*c* are mainly located within the frustum-shaped portion 24 and consequently a crimping operation having the effect of giving the frustum-shaped portion 24 a uniform diameter substantially equal to that of the cylindrical portion 22 has the effect of tightly connecting the end element 10 to the cable 12.

Figure 2:
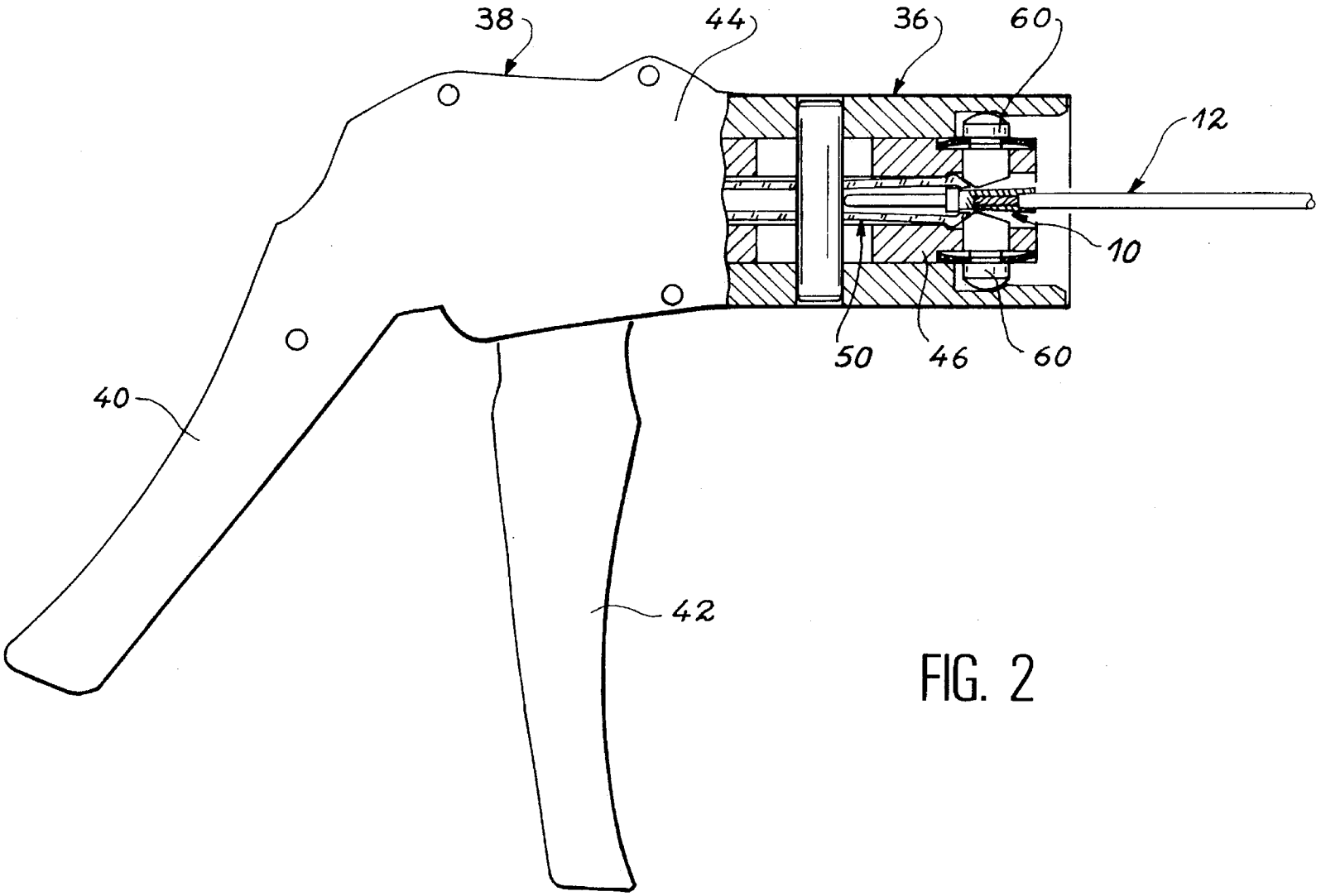
FIG. 2 A part sectional side view showing a preferred embodiment of a crimping tool according to the invention.
Figure 3:
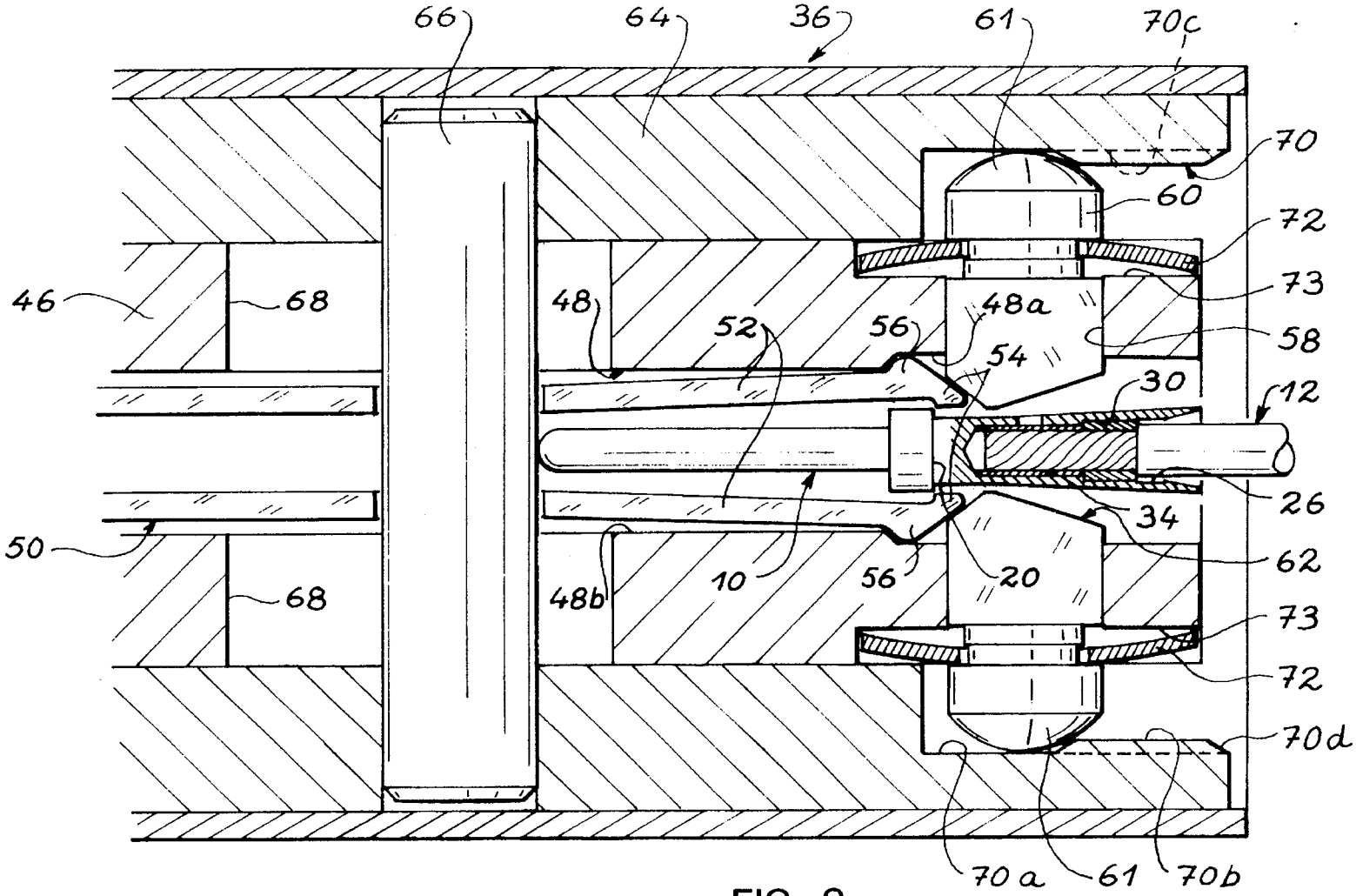
FIG. 3 A larger scale sectional view of the front portion of the tool of FIG. 2, said portion being illustrated in its loading position.

With reference to FIGS. 2 and 3 a description will now be given of a crimping tool according to the invention making it possible to connect the end of the cable 12 to the end element 10 by crimping the latter on the end of the cable by wire drawing.

In the embodiment of FIG. 2, the crimping tool according to the invention is essentially shaped like a pistol and comprises an active portion 36 for performing the crimping and a portion 38 constituting manipulating means.

The portion 38 of the crimping tool comprises a tool body 44 carrying a fixed handle 40 and an articulated mobile handle 42 constituting a tool manipulating member. The articulation of the mobile handle 42 on the tool body 44 takes place by means of a not shown ratchet or catch system making it necessary for the operator to actuate the tool up to the end of the cycle before said tool can return to its initial position. The mobile handle 42 can act on the mobile parts of the active portion 36 of the tool either directly, or via a force multiplier such as a rack and pinion system or a rod jamming system.

The active portion 36 of the tool according to the invention has a symmetry of revolution about a longitudinal axis. In the remainder of the description the words "front" and "rear" are used for designating the ends respectively furthest away and closest to the tool portion 38 along said longitudinal axis.

The crimping tool body 44 is extended in the portion 36 of said tool in the form of a tubular sleeve 46. As is more particularly illustrated by FIG. 3, said tubular sleeve 46 internally defines a recess 48 in the form of a bore, whose axis coincides with the longitudinal axis of the active crimping portion 36. The bore 48, which issues onto the front face of the tubular sleeve 46, serves to receive the end element 10 and the end of the cable 12 which it is wished to connect to said element. More specifically, the end element 10 is placed in the recess 48 in such a way that the bore 26 is turned towards the front face of the tubular sleeve 46. Preferably, the bush 30 and the ring 34, when they exist, have been placed beforehand in the bore 26. The end of the cable 12 can be introduced into the bore 26 before or after the end element 10 has been introduced into the recess 48.

Figure 6:
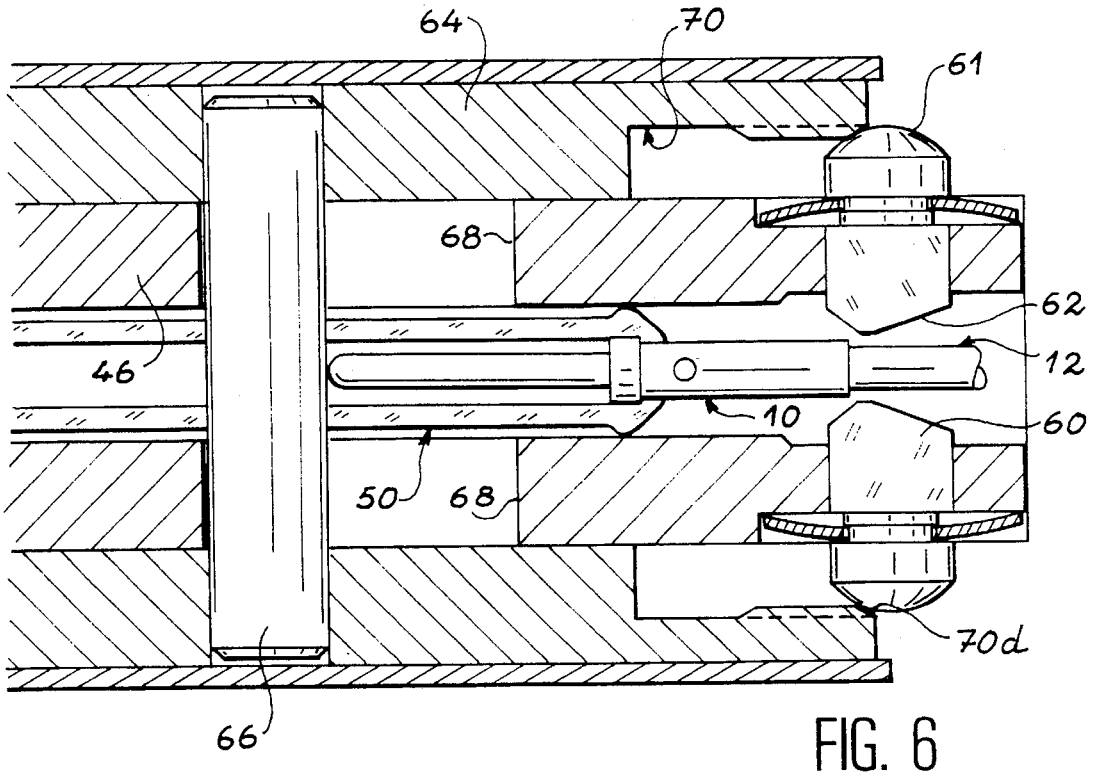
FIG. 6 A view comparable to FIGS. 3 to 5 showing the positions assumed by the different parts at the end of crimping.

A gripping plier 50 is located in the rear portion of the recess 48, so as to move in accordance with the longitudinal axis of said recess between a front loading position, illustrated in FIG. 3, and a rear end of crimping position, illustrated in FIG. 6. The movement of the gripping plier 50 between these two end positions is ensured by an actuation of the mobile handle 42 of the tool.

The gripping plier 50 comprises at least two jaws 52 extending substantially along the longitudinal axis of the recess 48 and urged radially towards the outside by elastic means. In the embodiment illustrated in the drawings, said elastic means are constituted by said jaws 52, whose inherent elasticity radially engages them towards the outside against the wall of the recess 48.

At its front end, each of the jaws 52 of the gripping plier 50 is internally terminated by a nose 54 able to bear on the shoulder 20 of the end element 10, when the latter is introduced into the recess 48, as illustrated in FIG. 3. More specifically, when the gripping plier 50 occupies its front loading position and an end element 10 has been introduced into the recess 48, as illustrated in FIG. 3, the noses 54 surround the cylindrical portion 22 (FIG. 1) and are slightly displaced towards the front with respect to the shoulder 20.

In said front loading position of the gripping plier 50, bosses 56 formed on the outer surfaces of the jaws 52, in the vicinity of their front end, are positioned facing a relatively large diameter portion 48*a* of the recess 48. Consequently, bearing in mind the elasticity of the jaws 52, the gripping plier 50 then occupies an open position able to permit the introduction and removal of the end element 10, as illustrated in FIG. 3.

The portion 48*a* of the recess 48 is extended rearwards by a smaller diameter portion 48*b*. More specifically, the bosses 56 are located substantially in contact with an inclined shoulder separating the portions 48*a* and 48*b* of the recess 48 when the gripping plier 50 occupies its front loading position. Consequently, as soon as the gripping plier 50 moves rearwards in accordance with the longitudinal axis of the recess 48, the bosses 56 penetrate the smaller diameter portion 48*b* of the recess 48, in such a way that the noses 54 of the plier close on the cylindrical portion 22 of the end element 10 and bear against the shoulder 20. A rearward displacement of the gripping plier 50 consequently has the effect of drawing the end element 10 in the same direction. Moreover, the gripping plier 50 remains locked on the end element until it has returned into its front loading position.

The front portion of the tubular sleeve 46 is radially traversed over all its periphery by bores 58, in which the crimping piston 60 can freely slide. More specifically, the axes of the crimping piston 60 are radial axes intersecting at the same point the longitudinal axis of the recess 48 and said axes are regularly distributed over the entire periphery of the recess.

When they occupy their position closest to the longitudinal axis of the recess 48, the crimping pistons 60 project into the interior of said recess 48, so as to be in contact with the adjacent pistons. In said crimping position, the end surfaces 62 of the piston 60 turn towards the interior of the recess 48 form an annular crimping die around the end element 10 received in the recess. The thus formed crimping die has a front, convergent, frustum-shaped portion, a central, cylindrical portion and a divergent, rear, frustum-shaped portion. The precise characteristics of these different portions are chosen, as for a conventional die, as a function of the characteristics of the part which it is wished to draw.

The outer surface of the noses 54 of the gripping plier 50 advantageously have a wedge shape complimentary to that of the rear, frustum-shaped portion of the crimping die. This feature makes it possible to maintain the crimping piston 60 in an open position, radially spaced from the longitudinal axis of the recess 48, when the gripping plier 50 occupies its front loading position illustrated in FIG. 3.

The active portion 36 of the crimping tool according to the invention also comprises a mandrel-shaped, annular member 64 slidingly mounted on the tubular sleeve 46. This annular member 64 is joined to the gripping plier 50 by a pin 66, which radially traverses windows 68 formed in the tubular sleeve 46. These windows 68 permit a sliding of the assembly formed by the annular member 64, the gripping plier 50 and the pin 66 with respect to the tubular sleeve 46, parallel to the longitudinal axis of the recess 48. For a reason which will become clear hereinafter, the windows 68 also permit a slight pivoting of the aforementioned assembly about the longitudinal axis of the recess 48 relative to the tubular sleeve 46.

In its front portion located around the crimping piston 60, the annular member 64 is internally provided with cam surfaces 70. Elastic means, e.g. constituted by elastic washers 72, bear on each of the crimping pistons 60 in order to keep a cambered, outer end face 61 of said pistons in engagement with the cam surfaces 70. More specifically, each of the elastic washers 72 is received in a groove formed on the periphery of the crimping piston 60 corresponding thereto and bears in the bottom of a spotfacing 73 machined on the outer surface of the tubular sleeve 46.

The cam surfaces 70 formed in the front portion of the annular member 64 comprise a relatively large diameter, rear cylindrical zone 70*a*, a relatively small diameter, front cylindrical zone 70*b* and open helical grooves 70*c* machined in the front cylindrical zone 70*b*.

When the annular member 64 is in a front position corresponding to the front loading position of the gripping plier 50, as illustrated in FIG. 3, the cambered end faces 61 of the crimping piston 60 bear against the rear cylindrical zone 70*a* of the cam surface 70. In view of the fact that said rear cylindrical zone 70*a* has a relatively large diameter, the crimping die formed by the inner surfaces 62 of the crimping piston 60 are then in an open position under the action of the elastic washers 72. This position makes it possible to introduce the end element 10 into the recess 48 and to extract it therefrom without any difficulty.

When the annular member 64 occupies its rear end position (FIG. 6) corresponding to the rear end of crimping position of the gripping plier 50, the cambered end faces 61 of the crimping pistons 60 are in contact with a chamfer 70*d* formed at the front of the front cylindrical zone 70*b* of the cam surface 70. Consequently, the crimping pistons 60 again occupy a position corresponding to the opening of the crimping die formed by the surfaces 62 of the pistons.

Between the two end positions of the annular members 64 described hereinbefore, the cambered end faces 61 of the crimping pistons 60 bear either against the front cylindrical zone 70*b* (FIG. 5) or in the bottom of the helical grooves 70*c*.

In the first case, i.e. when the cambered end faces of the crimping pistons 60 bear against the front cylindrical zone 70*b*, the crimping pistons are radially forced towards the inside in opposition to the action of the elastic washers 72 into a closure position of the crimping die formed by the surfaces 62 of the pistons. The pistons 60 are in this position when the annular member 64 moves with the gripping plier 50 from its front end position to its rear end position.

Thus, the cambered end faces 61 of the crimping pistons 60 are automatically displaced with respect to the rear ends of the helical grooves 70*c*, when said cambered end faces 61 return into engagement with the rear cylindrical zone 70*a*. This result is obtained by the fact that, simultaneously with the arrival of the cambered end faces 61 of the pistons in the rear cylindrical zone 70*a*, the pin 66 bears against a not shown, inclined edge of each of the windows 68. This automatically brings about a relative rotation of the annular member 64 with respect to the tubular sleeve 46, which has the effect of obtaining the desired angular displacement between the cambered end faces 61 and the rear ends of the helical grooves 70*c* issuing into the rear cylindrical zone 70*a*.

Figure 7:
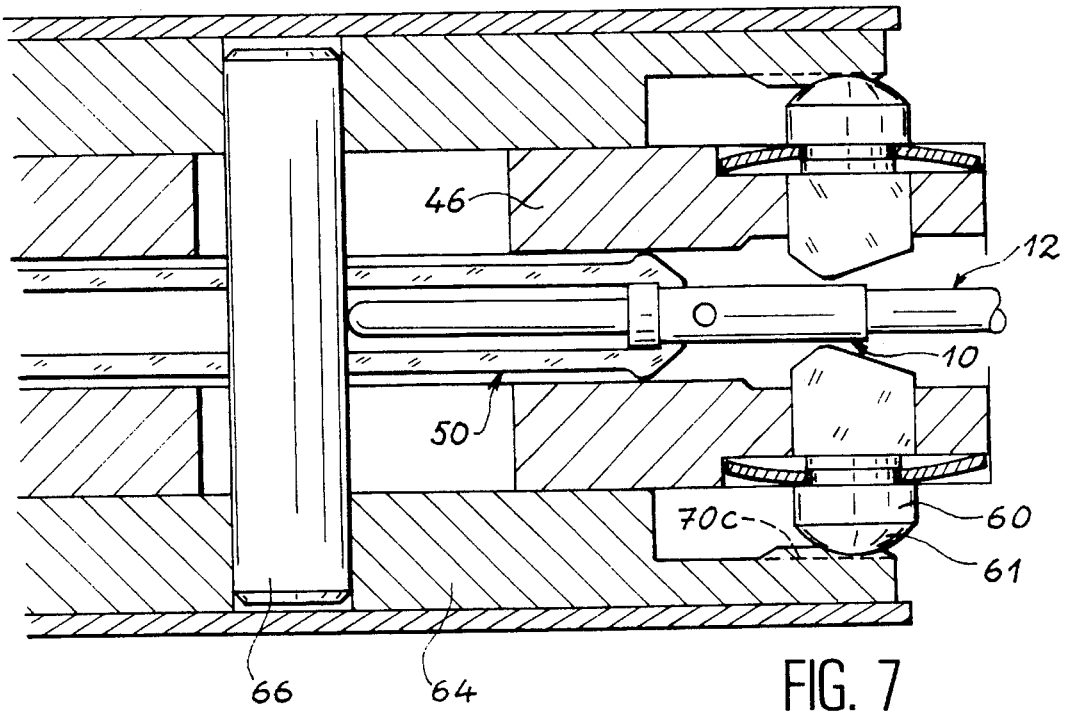
FIG. 7 A view comparable to FIGS. 3 to 6 illustrating the return of the different parts to the tool inoperative position.

The helical grooves 70*c* are machined in the front cylindrical zone 70*b* in such a way that their bottom is flush with the rear cylindrical zone 70*a*. In other words, the depth of these grooves 70*c* is the same as that of the zone 70*b*. In addition, there are the same number of helical grooves 70*c* as there are crimping pistons 60 and the grooves are regularly distributed over the entire periphery of the cam surface 70. Furthermore, the width of the helical grooves 70*c* is calculated in such a way that the cambered end faces 61 of the crimping pistons 60 bear in the bottom of the grooves when the pistons face the latter. Consequently when the cambered end faces of the crimping pistons 60 are located in the helical grooves 70*c* (FIG. 7) the crimping die formed by the surfaces 62 of the pistons is in the open position.

In practice, the crimping pistons 60 circulate in the helical grooves 70*c* when the assembly formed by the annular member 64 and the gripping plier 50 moves from its rear position to its front position. This result is obtained by the fact that at the end of the rearward displacement of the annular member 64, during which the cambered end faces 61 of the crimping pistons 60 bear on the front cylindrical zone 70*b*, the cambered end faces 61 of the pistons are positioned in front of the front ends of the helical grooves 70*c*, which issue onto the chamfer 70*d*.

The path of the cambered end faces 61 of the crimping pistons 60 in the helical grooves 70*c* is accompanied by a rotation of the assembly formed by the annular member and the gripping plier 50 with respect to the tubular sleeve 46 authorized by the special shape of the windows 68. The not shown, inclined edge of these windows, which permits the angular displacement of the cambered end faces 61 of the crimping pistons 60 relative to the rear ends of the helical grooves 70*c*, which issue into the rear cylindrical zone 70*a*, brings about a rotation of the annular member 64 and the gripping plier 50 in the opposite direction and with the same amplitude as that produced by the helical grooves 70*c*.

The realization of the crimping tool according to the invention will now be described successively relative to FIGS. 3 to 7.

When the tool is in the inoperative position, i.e. prior to any actuation of the mobile handle 42, the gripping plier 50 and the annular member 64 occupy their front positions illustrated in FIG. 3. In this position, it is pointed out that the gripping plier 50 is open, as is the die formed by the surfaces 62 of the crimping pistons 60. The end element 10 containing the bush 30 and the ring 34 can thus be introduced into the recess 48 until it abuts, e.g. against the pin 66 in the embodiment described. As a function of the particular case, the end of the cable 12 is introduced into the end element 10 before or after the latter has been put in place in the recess 48.

The operator then actuates the mobile handle 42, which displaces the gripping plier 50 and the annular member 64 in the rearwards direction. As from the start of this displacement, the gripping plier 50 closes on the cylindrical surface 22 of the end element 10, under the effect of the penetration of the bosses 56 into the smaller diameter portion 48*b* of the recess 48. The noses 54 are then anchored against the shoulder 20 of the end element 10, so that the later is drawn towards the rear during the remainder of the displacement of the gripping plier 50.

Figure 4:
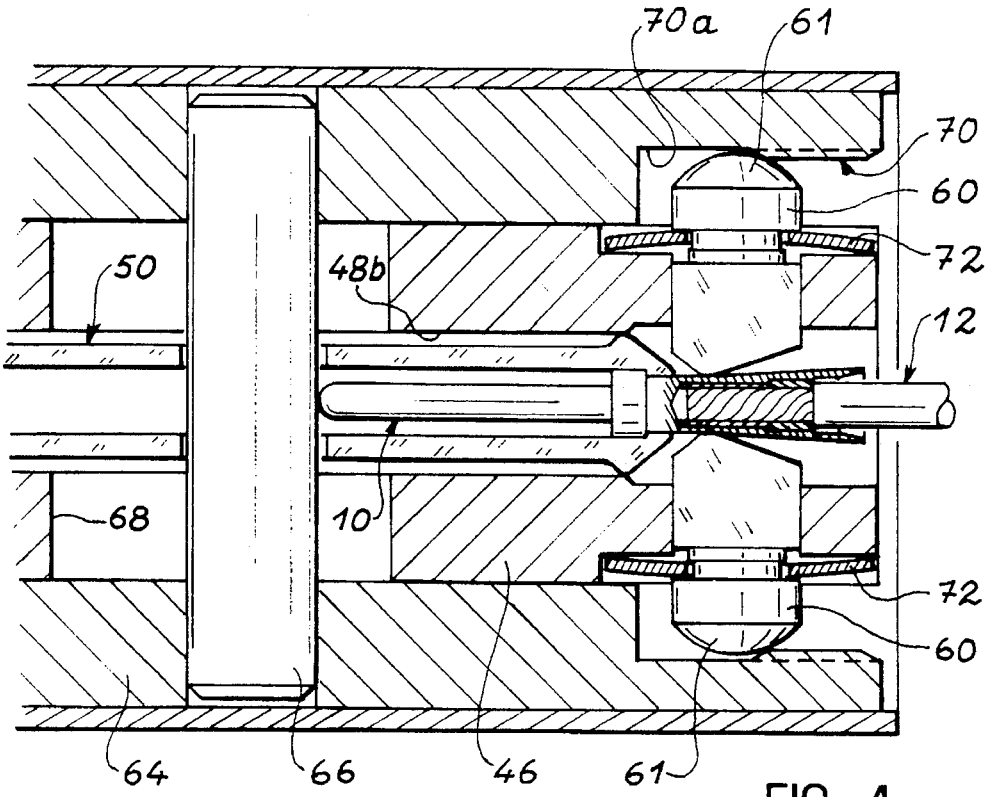
FIG. 4 A sectional view comparable to FIG. 3 illustrating the positions assumed by the different parts at the start of tool actuation.
Figure 5:
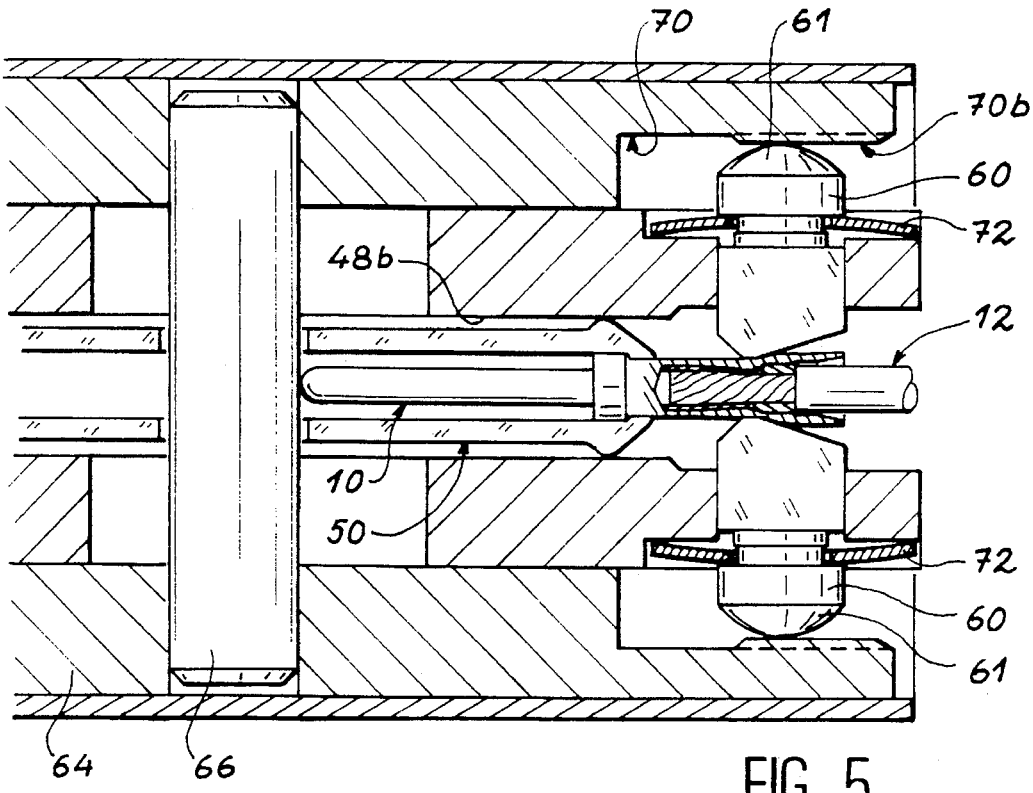
FIG. 5 A sectional view comparable to FIGS. 3 and 4 illustrating the positions of the different parts during crimping.

Moreover, as from the start of the rearward displacement of the annular member 64, the die formed by the surfaces 62 of the crimping pistons 60 closes again, as a result of the rise of the cambered end faces 61 of the pistons on the front cylindrical zone 70*b* of the cam surfaces 70. The circular intermediate portion of the inner surfaces 62 forming the crimping die then have an internal diameter substantially equal to the external diameter of the cylindrical portion 22 of the end element 10. Consequently, the relative displacement between said end element 10 and the crimping die, during the rearward displacement of the gripping plier 50, leads to the crimping by wire drawing of the end element 10 on the end of the cable 12. FIGS. 4 and 5 illustrate two successive stages of this crimping operation.

When the gripping plier reaches its rear, end of crimping position, the rear end of the end element 10 is slightly rearward of the die formed by the surfaces 62 of the crimping pistons 60. Simultaneously and as illustrated in FIG. 6, the cambered end faces 61 of the crimping pistons 60 bear against the chamfer 70*d*, which leads to a recoil of the crimping pistons radially towards the outside corresponding to an opening of the die.

As indicated hereinbefore, the cambered end faces 61 of the crimping pistons 60 are then in front of the ends of the helical grooves 70*c*. Consequently, when the operator releases the mobile handle 42 in such a way that the not shown, elastic return means incorporated into the tool bring the gripping plier 50 and the annular member 64 to their front positions, the crimping pistons 60 pass through the helical grooves 70*c*. The crimping die formed by the inner surfaces 62 of the crimping pistons 60 consequently remains in the open position and does not impair the return of the tool to the inoperative position.

As soon as the cambered end faces 61 of the crimping pistons 60 arrive in the rear cylindrical zone 70*a* of the cam surfaces 70, the pin 66 bears against the not shown, inclined edges of the windows 68, which has the effect of angularly displacing the ends of the crimping pistons 60 with respect to the rear ends of the helical grooves 70*c* issuing into the rear cylindrical zone 70*a*. In this angular position, the front ends of the crimping pistons 60 are angularly aligned with the ends of the helical grooves 70*c*, which issue onto the chamfer 70*d*.

At the end of the forward displacement of the gripping plier 50, the bosses 56 arrive in the relatively larger diameter portion 40*a* of the recess 48, so that the gripping plier 50 opens automatically and the end of the cable 12, on which has been crimped the end element 10, can be withdrawn from the recess 48. The crimping tool is ready to be used again for carrying out an identical operation.

We claim:

1. Crimping tool for the connection of an electric cable in an end element having a frustrum shaped outer surface, wherein said crimping tool comprises:

a tool body provided with a recess having a given longitudinal axis, said recess having a rear portion and a front portion adapted to receive the end element, a gripping plier having gripping elements normally spaced from said longitudinal axis, said plier being located in said rear portion of the recess and being moveable along said longitudinal axis between a front position for loading said end element and a rear position for crimping said end element, means for automatically moving said gripping elements towards said longitudinal axis when said plier is moved from its front position, a crimping die located in the tool body adjacent said front portion of said recess spaced from said longitudinal axis and being moveable in a direction substantially perpendicular to said longitudinal axis between a crimping position and an open position and crimping control means for maintaining the crimping die in its crimping position when the gripping plier moves from its front position to its rear position, and for maintaining said crimping die in its open position when the gripping plier is in either its rear or front positions and when it moves from its rear position to its front position.

2. Crimping tool according to claim 1, wherein the crimping die comprises crimping pistons slideably mounted in the tool body.

3. Crimping tool as claimed in claim 2 wherein said crimping pistons are arranged in paris on opposite sides of said longitudinal axis, each of said pairs being arranged to intersect said longitudinal axis at the same point.

4. Crimping tool according to claim 2, wherein said crimping control means include an annular member, having a longitudinal axis substantially coinciding with said axis of said recess, surrounding the crimping pistons and having internal cam surfaces, elastic means maintaining each crimping piston in engagement with said cam surfaces, and means for linking in movement parallel to said longitudinal axis, the gripping plier and the annular member.

5. Crimping tool according to claim 4, wherein the crimping control means includes a manipulating member adapted to exert a force on the gripping plier along said longitudinal axis to move said plier towards the rear portion of the recess, and means for returning the manipulating member to an inoperative position in which said plier is in its front position.

6. Crimping tool according to claim 4, wherein said tool body has a cylindrical portion having a longitudinal axis substantially coinciding with said axis of said recess and the means for linking in movement the gripping plier and the annular member comprise a pin, which traverses said cylindrical portion of the tool body and on which the annular member is slideably mounted to move with said plier between its front and rear positions.

7. Crimping tool according to claim 6, wherein the cam surfaces comprise:

a rear cylindrical zone having a first diameter and spaced a first distance from said front portion of said recess, a front cylindrical zone having a second diameter smaller than said first diameter and being spaced a second distance from said front portion of said recess, said second distance being shorter than said first distance, said crimping pistons being located in said rear cylindrical zone when said annular member and said plier are in said front position, said crimping pistons being located in said front cylindrical zone when said annular member and said plier are in said rear position.

8. Crimping tool as claimed in claim 7 wherein said cam surfaces of said annular member include helical grooves having front and rear ends and adapted to cooperate with said crimping pistons to rotate said pistons about said longitudinal axis as said gripping plier is moved from its front position to its rear position.

9. Crimping tool according to claim 8, wherein said cylindrical portion of said tool body includes openings and wherein the pin traverses said openings, said openings allowing a slight rotation of the annular member with respect to the tool body and incorporating an inclined ledge adapted to come into contact with the pin in order to automatically bring the annular member into a desired angular position about said longitudinal axis when said annular member and said plier occupy, its front position, said desired angular position being such that the crimping pistons are then angularly aligned with the front ends of the grooves and angularly displaced relative to the rear ends of said grooves.

10. Crimping tool according to claim 1, wherein second elastic means are provided for urging said gripping elements of the gripping plier away from said longitudinal axis towards an open position, said means for automatically moving said gripping elements towards said longitudinal axis includes a section of the rear portion of the recess which has a diameter smaller than said portion thereof.

11. Crimping tool according to claim 1, wherein the gripping plier comprises noses able to bear against a shoulder formed on the outer surface of the end element.

* * * * *